United States Patent [19]

Julius

[11] 4,185,754

[45] Jan. 29, 1980

[54] COLLAPSIBLE RECLOSEABLE DISPENSER PACKET WITH TWO PART RESEALABLE CLOSURE

[75] Inventor: Robert P. Julius, New York, N.Y.

[73] Assignee: Nice-Pak Products, Inc., Mount Vernon, N.Y.

[21] Appl. No.: 915,013

[22] Filed: Jun. 13, 1978

Related U.S. Application Data

[63] Continuation-in-part of Ser. No. 668,682, Mar. 19, 1976, Pat. No. 4,156,493.

[51] Int. Cl.[2] ..... A47K 10/20

[52] U.S. Cl. ..... 221/63; 206/210

[58] Field of Search ..... 221/63; 206/210; 222/107, 543, 83, 82; 150/8, 2.1

[56] References Cited

U.S. PATENT DOCUMENTS

| | | | |
|---|---|---|---|
| 2,950,847 | 8/1960 | Tupper | 222/543 X |
| 3,127,064 | 3/1964 | Fairchild | 222/543 X |
| 3,173,579 | 3/1965 | Curie et al. | 222/107 X |
| 3,306,327 | 2/1967 | Ilg | 150/8 X |
| 3,641,999 | 2/1972 | Greene | 222/107 |
| 3,930,286 | 1/1976 | McGowen | 222/83 |
| 4,002,264 | 1/1977 | Marchesani | 221/63 |

*Primary Examiner*—Stanley H. Tollberg

*Attorney, Agent, or Firm*—Gottlieb, Rackman & Reisman

[57] ABSTRACT

A recloseable dispenser packet wherein articles, such as moisture impregnated towelettes, are readily accessible to the user. Both semi-rigid and flexible embodiments of the invention are described, and each embodiment employs a resealable closure whereby the packet may be opened for dispensing of individual towelettes and thereafter closed to maintain the packet in a hermetically sealed condition. A limp-pack, flexible packet embodiment has an improved cover closure structure. This structure includes a collar portion which is hermetically sealed to the flexible packet material and a detachable hinge member with snap-on type cover cap attached thereto. The flexible packet may also be made of three-part laminated material. Another embodiment of the limp-pack device is formed of overlapped and sealed material with gussets provided at each end of the sealed pocket.

17 Claims, 17 Drawing Figures

COLLAPSIBLE RECLOSEABLE DISPENSER PACKET WITH TWO PART RESEALABLE CLOSURE

CROSS-REFERENCE TO RELATED APPLICATION

This is a Continuation-in-Part Application of copending U.S. Patent Application Ser. No. 668,682 filed Mar. 19, 1976 now Pat. No. 4,156,493.

BACKGROUND OF THE INVENTION

1. Field of the Invention:

The present invention is directed to a collapsible moisture impermeable packet containing moisture impregnated articles accessible through a resealable opening for individual dispensing.

2. Description of the Prior Art:

Substantially wet sheets, tissues, wipes or towelettes such as are generally utilized for personal hygiene, cosmetic purposes, household cleaning applications and the like, have gained great popularity over the past several years. However, the containers used for storage of these items have generally been designed for bulk storage, of a large number of items, or for individual storage, of one item.

Each of the prior art techniques for packaging fail to satisfy a need for providing an inexpensive hermetically resealable packet for storing a small number of towelettes convenient for carrying in a pocket or purse.

U.S. Pat. No. 3,780,908 to Fitzpatrick et al, U.S. Pat. No. 3,836,044 to Tilp et al and U.S. Pat. No. 3,841,466 to Hoffman et al each provide for moisture-impermeable packages with sealing lid means to prevent moisture-impregnated towelettes from drying out, before they are dispensed. Each of the packages in the above-cited patents are concerned with bulk packaging, wherein a large number of sheets or towelettes are stored at one time. Such bulk packaging techniques are not readily convertible to satisfy the limitations imposed upon the packaging of a small number of towelettes.

Other moisture-impermeable packaging techniques have been shown in U.S. Pat. No. 3,784,056 to Spruyt et al and U.S. Pat. No. 3,862,703 to Dutcher.

In the Spruyt patent, a semi-rigid tray like container is shown with two overlapping thin, flexible materials attached to the outer edges of the tray. The overlapping sections of the flexible materials define a slit closure, which is elongated in a predetermined direction. The container is differentially stressed to apply a slit-sealing tension force in the direction of the slit elongation and the overlapping material sections to effect a substantially moisture-impermeable closure. It is apparent that the sealing system of the Spruyt patent does not provide for a positively sealed container since a relief of the tension forces by inadvertent compression of the ends of the container may easily cause the sealing relationship to be destroyed.

The Dutcher patent shows a reclosable plug-type dispensing package wherein a tray of sheet plastic is used as a container for liquid impregnated wiping tissue. The tray includes a bottom wall and upwardly inclined end and side walls having a commonly planer flange edge over which a heat sealable paperboard is sealed thereto to provide a top for the dispenser package. The top is provided with a weakened portion which forms an opening to access the towelettes in the tray. When the opening is formed and the portion of the paperboard top is removed, a plug is used to fill the opening and provide a sealing means for the package. It is apparent that the Dutcher patent presents a packaging technique which is both complicated in its construction and in its use.

SUMMARY OF THE INVENTION

The present invention is intended to overcome the problems of the prior art by presenting a hermetically resealable personal size packet for containing a convenient number of moisture impregnated items, such as towelettes or wipes. The personal size packet of the present invention is convenient to carry in a purse or pocket, overcomes the bulkiness of the prior art containers and eliminates the waste and expense generated by the prior art packaging of individual towelettes.

It is an object of the present invention to provide a hermetically sealed packet for containing moisture impregnated items, which is both economical to make and convenient to carry in a purse or pocket.

It is an object of the present invention to provide a hermetically sealed packet having a resealable closure structure for allowing the removal of moisture impregnated items and allowing the packet to be hermetically resealed. A reclosable cap structure having a collar portion hermetically sealed to the packet with a removable hinge member connected to a cover closure for association with an upstanding portion of the collar is also provided.

Another object of the present invention is to provide a flexible hermetically sealed packet containing premoistened towelettes having a central aperture provided with a two-part hinge type reclosable cover structure.

It is a further object of the present invention to provide a hermetically resealable packet of flexible, relatively limp material which is compressible and collapsable to allow the access opening to be immediately adjacent the articles within the packet.

Another further object of the present invention is the combination of a flexible pouch with a rigid or semi-rigid, sealed-in recloseable closure structure.

It is still a further object of the present invention to provide a hermetically resealable packet formed of flexible material to allow for manual compression of the packet during the removal of articles therefrom. Formed of flexible material a centrally orientated two-part resealable cover closure structure is firmly attached to the packet. A detachable hinge permits the cover cap to be completely removed from the closure cover collar for ease of manufacture and assembly. The packet itself may be formed of two or three-part laminated, yet flexible material.

A still yet further object of the present invention is to provide a flexible pouch formed of a single sheet of flexible material folded so as to enclose the towelette contents. An overlapping seam is formed which is permanently sealed. The overlaps at each end are also permanently sealed. Expandable gussets may also be provided at each of the pouch ends at each side thereof. A rigid or semi-rigid resealable closure structure is provided in the pouch side opposite to the sealed overlapping seam side. Thus a flexible pouch with a rigid sealed-in recloseable closure is formed to provide a package which is hermetically sealed for moist impregnated wipes, for easy dispensing and portability.

DESCRIPTION OF THE PREFERRED EMBODIMENTS

The present invention provides for a novel hermetically sealed packet for containing items which must necessarily be protected from the atmosphere. Such items include moisture impregnated towelettes which may be made from a variety of materials including paper, fabric (non-woven or woven) or sponge. Other items which may be contained within the packet of the present invention include all families of liquid products, from water based solutions to solvent based liquids, having viscosities which range from free flowing liquids to lotions and creams. Although the range of usage and application of the present invention will be obvious from the following disclosure, the following description is made with respect to moisture impregnated towelettes which are folded and stacked in the packet so as to present a free edge accessible through a resealable closure. This arrangement facilitates the withdrawal of individual towelettes therefrom.

Figure 1A:
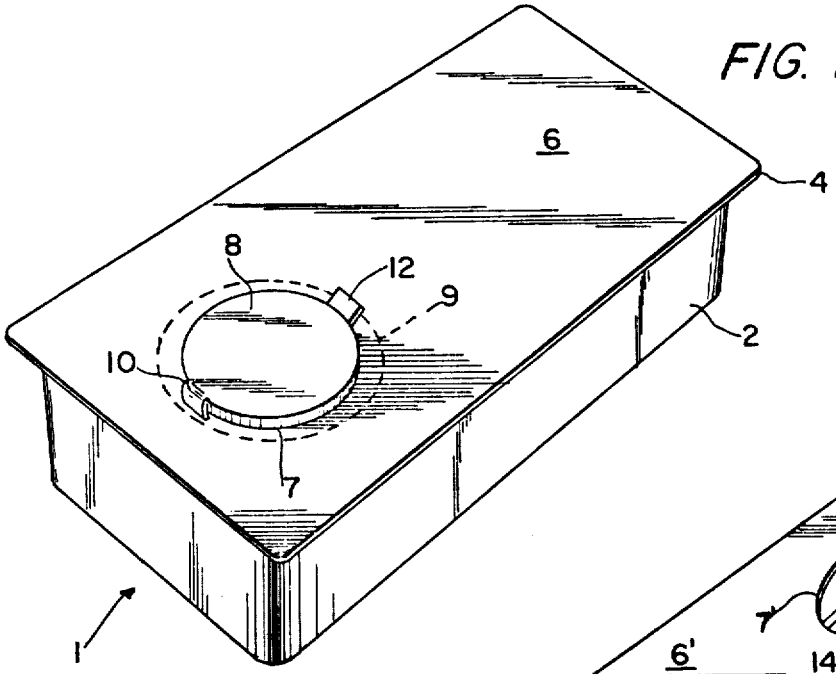
FIG. 1A shows a first embodiment of the present invention employing a semi-rigid container with a hermetically sealed top and reclosable cap.

FIG. 1A shows a first embodiment of the present invention, wherein the packet 1 is formed of a semi-rigid tray type container 2. The container 2 is generally rectangular in shape having side walls which extend from the bottom thereof in an upward direction terminated by a flange edge 4 at the top thereof. The semi-rigid container 2 is preferably made of vinyl material, or the like, which may be thermo-formed or injection molded.

A thin, flexible material 6, such as vinyl film or aluminum foil or any other material which provides a high moisture vapor barrier, is sealed to the flange 4 of the container 2 by conventional sealing methods (i.e., heat, ultrasonic or adhesive sealing). The thin, flexible material 6 is provided with an opening 7, through which the contents of the packet 1 may be accessed by the user.

In FIG. 1A a resealable cap 8 is shown attached to the thin, flexible material 6 at the opening 7 and thereby provides a reclosing mechanism to maintain the container in a hermetically sealed condition. The cap 8 is preferably constructed as a single unit with a flexible "living" hinge 10, a pull tab 12 and a lower collar 9. (It is understood that cap 8, the pull tab 12, and the hinge 10 may be separate elements with respect to the lower collar 9 and would necessarily be assembled to form a single unit.) The collar 9 is attached to the underside of the thin, flexible material 6 by applying an adhesive therebetween. In the alternative, other well known methods such as heat sealing or ultrasonic sealing may be used to attach the collar 9 to the material 6. The method of attaching the collar 9 to the material 6 is not a critical part of the invention, so long as the contents of the container are maintained in a hermetically sealed condition, when the cap 8 is closed.

Figure 1B:
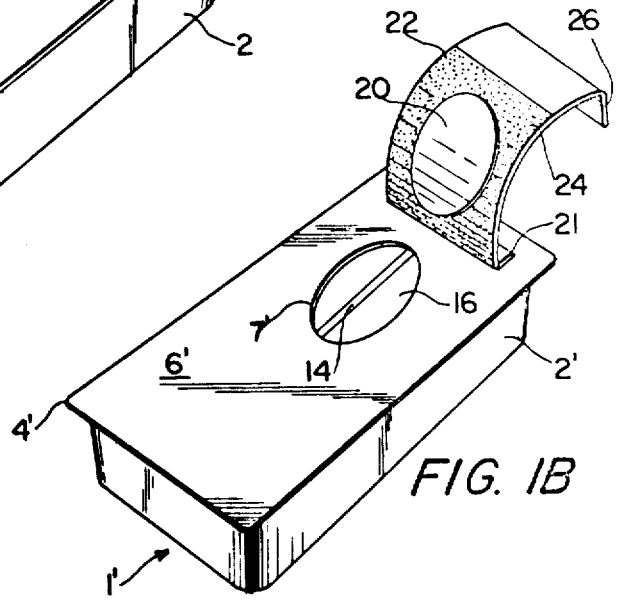
FIG. 1B shows a second embodiment of the present invention similar to that shown in FIG. 1A, with an adhesive type resealable closure.

FIG. 1B shows a second embodiment of the present invention similar to that shown in FIG. 1A (like elements are indicated in prime notation). The packet 1′ is constructed in a similar fashion to the embodiment of FIG. 1A, but provides an alternative closure concept. In the embodiment shown in FIG. 1B, the flexible material 6′ is shown with a discontinuous area defining an opening 7′ therein. Preferably, the defined opening 7′ is die cut, or perforations are cut into the material 6′ to form the general outline of the opening 7′. The opening 7′ may take the form of a circle, an oval, a slit or any other desired shape which will be evident from the following disclosure.

A closure flap 22, which is preferably made of a moisture impermeable material similar to material 6′ (but may also be made from a woven material) is permanently attached, at one end thereof, to the material 6′ in a conventional manner to form a hinge 21. The closure flap 22 is attached to the material 6′ in an orientation, with respect to the opening 7′, that allows the flap 22 to extend over and surround the opening 7′, when the flap 22 is lying flat thereover. The flap 22 contains a non-hardening contact adhesive coating 24 which extends from the hinge 21 to an area designated as an end pull tab 26. The area covered by the adjesive 24 corresponds to the area of the opening 7′ and an area surrounding the opening 7′. The flap 22 is thereby pressure sensitive and provides a hermetic seal to the contents 16 of the container 1′, since the flap 22 is flexibly hinged to lie flat over the flexible material 6′ and be adhesively attached thereto over the area covered by the adhesive 24. When a user pulls on the tab 26 in an upward manner, the flap 22 is thereby rotated and withdraws the die cut portion 20 (defined as the material 6' outlined by the opening 7'). The user causes the flap 22 to rotate until an opening 7' is exposed sufficiently to allow withdrawal the contents of the packet 1' (indicated as folded moisture impregnated towelettes 16 having a free edge 14). The packet 1' is then resealed by rotating the flap 22 so that it again adhesively attaches to the upper surface of the material 6'. The portion 20 therefore returns to its original position in the opening 7' and the packet 1' is sealed around the opening 7' by the adhesive area 24 of the flap 22.

Figure 2:
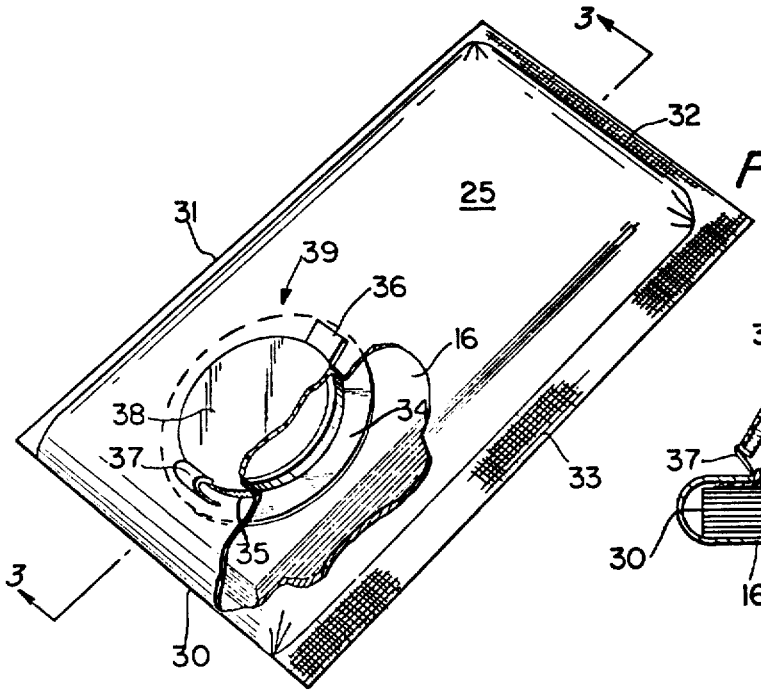
FIG. 2 shows a third embodiment of the present invention wherein a hermetically sealed flexible container employs a resealable cap.
Figure 3:
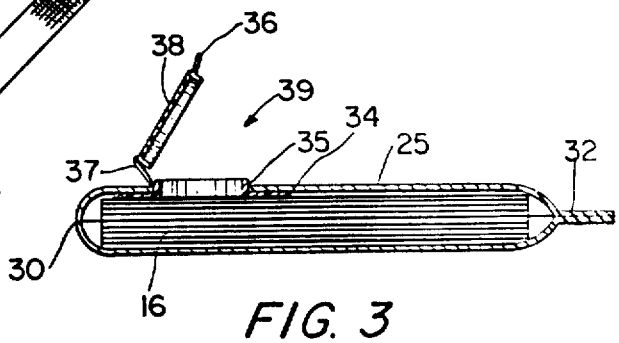
FIG. 3 shows a cross-section of the container shown in FIG. 2.

A third embodiment of the present invention is shown in FIG. 2, with a cross-section thereof shown in FIG. 3. FIGS. 2 and 3 show a flexible packet 25 formed of a single sheet of flexible material, such as a vinyl film, foil or any other flexible material which can be permanently sealed to provide a hermetically sealed container.

A discontinuous area defining an opening 35 is formed in the flexible material, preferably before the packet 25 is formed. The opening 35 is of sufficient size to allow a resealable cap assembly 39 to protrude therethrough and to be attached to the flexible material.

A resealable cap assembly 39 shown in FIGS. 2 and 3 has a resealable cap 38 being connected to a flexible "living" hinge 37. A pull tab 36 is formed on the cap 38 and the hinge 37 is attached to a collar 34. The collar 34 of the cap assembly 39 is preferably attached to a surface of the flexible material by one of the methods suggested in the discussion of the embodiment shown in FIG. 1A.

The packet 25 is formed about the towelettes by folding the flexible material along a median line defining a fold edge 30 and sealing the folded flexible material along exposed edges 31, 32 and 33. The packet 25 is sealed by a conventional method, such as heat sealing, ultrasonic sealing, or by using a strong adhesive, to obtain a permanent seal.

The resealable cap assembly 39 thereby provides a means for exposing the towelettes 16 for access by a user and also provides a resealing means whereby the moisture impregnated towelettes 16 remaining in the packet 25 may be maintained in a hermetically sealed condition.

Figure 4A:
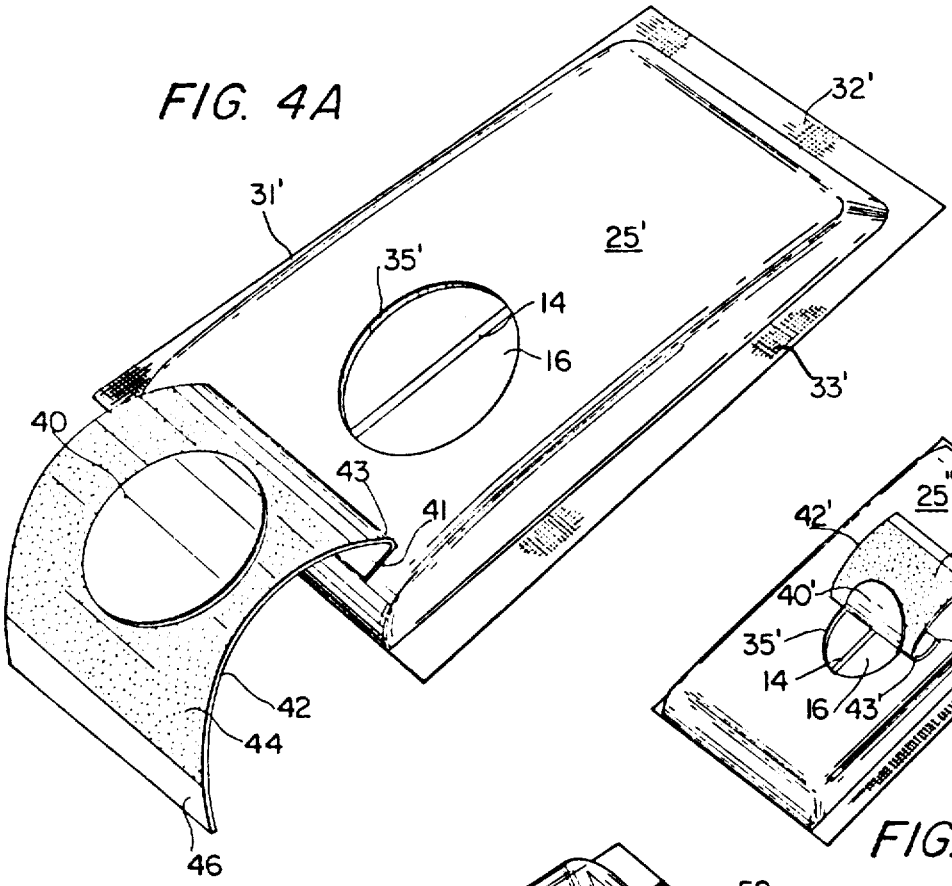
FIG. 4A shows a fourth embodiment of the present invention wherein a hermetically sealed flexible container employs an adhesive type resealable closure.

FIG. 4A presents a flexible towelette packet embodiment similar to that shown in FIGS. 2 and 3 (like elements are indicated in prime notation). The flexible packet 25' is sealed about edges 31', 32' and 33' to form a hermetically sealed packet. The contents, shown here as moisture impregnated towelettes 16, are enclosed within the sealed packet 25'. A discontinuous area defining an opening 35' is formed on one surface of the packet 25' by a die cut or perforations cut into the material forming the packet 25'.

In this embodiment, a flap 42 is permanently attached, at one end 41 thereof, to the packet 25', thereby defining a flexible hinge 43. The flap 42 is quite similar to that shown in FIG. 1B and contains a non-hardening contact adhesive 44 covering an area which is greater than the size of the defined opening 35'. A pull tab 46 is also defined on the flap 42 as an area free of adhesive 44. During construction of the packet 25', the flap 42 is permanently attached at 41 and oriented to cover the defined opening 35'. Therefore, when the packet 25' is first opened, the die cut portion 40 of the flexible material in the defined opening 35' becomes separated from the opening 35' and remains adhesively attached to the flap 42, thereby allowing one to access and remove the towelettes 16 by fold edge 14.

Figure 4B:
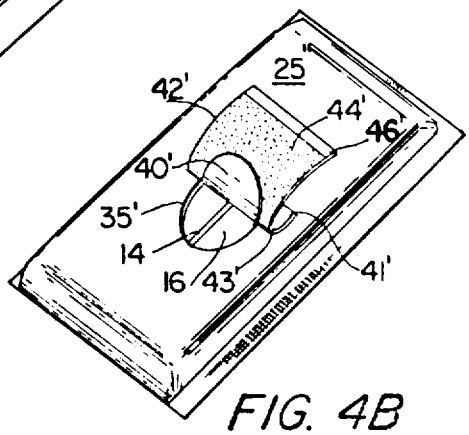
FIG. 4B shows a fifth embodiment of the present invention similar to that shown in FIG. 4A, with a centrally located resealable closure.

FIG. 4B indicates an embodiment similar to that shown in FIG. 4A. In this embodiment, a packet 25" has a flap 42' permanently attached thereto at 41' to provide a flexible hinge 43'. In this embodiment, the discontinuous area defining an opening 35' is formed by an incomplete die cut, wherein a die cut portion 40' is not detachable from the material forming packette 25". In this case, the flap 42' may be rotated in an upward direction with respect to the packet 25, the die cut portion 40' is rotated with the flap 42' and does not become detached from the opening 35" or the material forming packet 25".

Figure 5A:
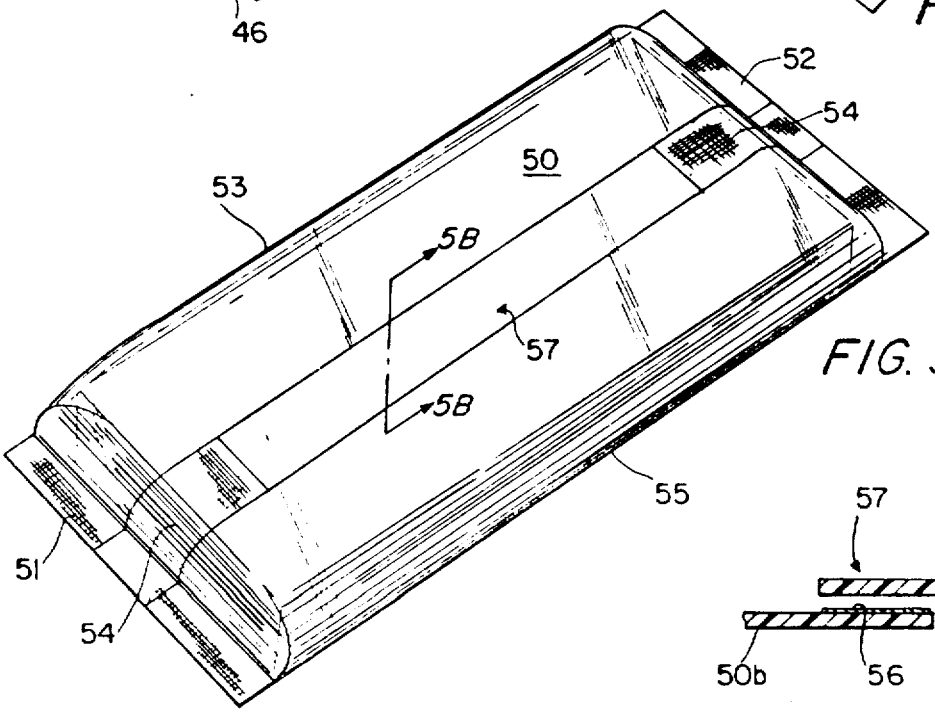
FIG. 5A shows a sixth embodiment of the present invention wherein a hermetically sealed flexible container employs a resealable seam.

A further embodiment of the present invention is shown in FIG. 5A. A packet 50 is formed of a single sheet of flexible material similar to that employed in a construction of the embodiments shown in FIGS. 2, 3, 4A and 4B. In this case, a single sheet of flexible material having two substantially parallel edges is folded along fold edges 53 and 55 to enclose the towelette contents. An overlapping seam 54 is formed, by the two parallel edges, which runs lengthwise over the packet 50. A portion of the seam 54, designated as 57, provides a resealable closure 57, wherein access can be made to the contents of the packet 50. The packet 50 is permanently sealed along edges 51 and 52 in order that the contents will remain hermetically sealed therein.

Figure 5B:
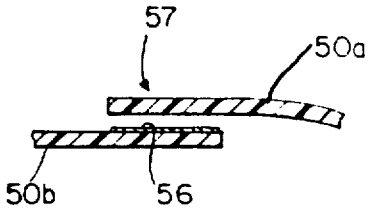
FIG. 5B is a detailed view of the resealable seam shown in FIG. 5A.

FIG. 5B shows a partial cross-section of the resealable closure 57, wherein the flexible material section designated as 50*a* overlaps the flexible material section 50*b* as provided by the overlapping seam 54. A non-hardening contact adhesive 56 is preferably applied to the upper surface of the section 50*b* to effect the pressure sensitive resealable closure 57, when the section 50*a* is contacted with the section 50*b*. The sections may be separated to provide access to the contents of the packet 50 by peeling the upper section 50*a* from the lower section 50*b*.

It is recognized that other means may also be used to form the resealable closure 57. For instance, a "zip lock" may be used wherein the overlapping portions of the closure 57 are made to elastically interlock.

The embodiments shown in FIGS. 2-5B, illustrate flexible packages which are extremely convenient, since due to their flexible nature the package tends to compress as the articles are removed therefrom. This collapsing or compression of the package facilitates easy removal of the contents therefrom through the comparatively small resealable opening, since the articles are immediately adjacent that opening. Compared with a more rigid container, wherein the opening is relatively stationary with respect to the bottom of the container, as the articles are withdrawn therefrom one has to reach further into the packet in order to remove each subsequent article. Therefore, in the more rigid containers, it may be necessary to make the opening large enough to allow one to insert at least two fingers into the packet to a depth sufficient for grapsing the final article.

Figure 9:
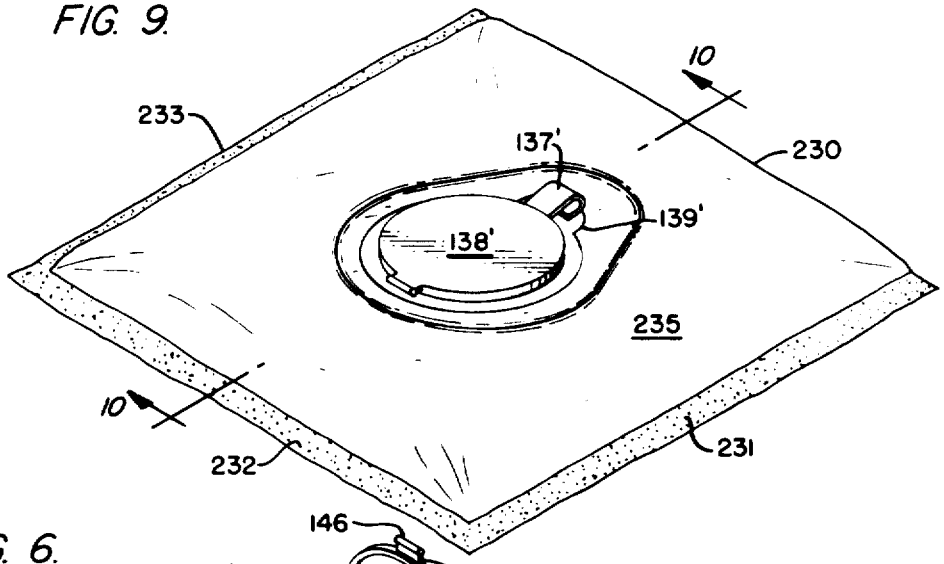
FIG. 9 shows a modification of the embodiment of FIG. 6 wherein a flexible container similar to that shown in FIG. 6 has a substantially square configuration.
Figure 6:
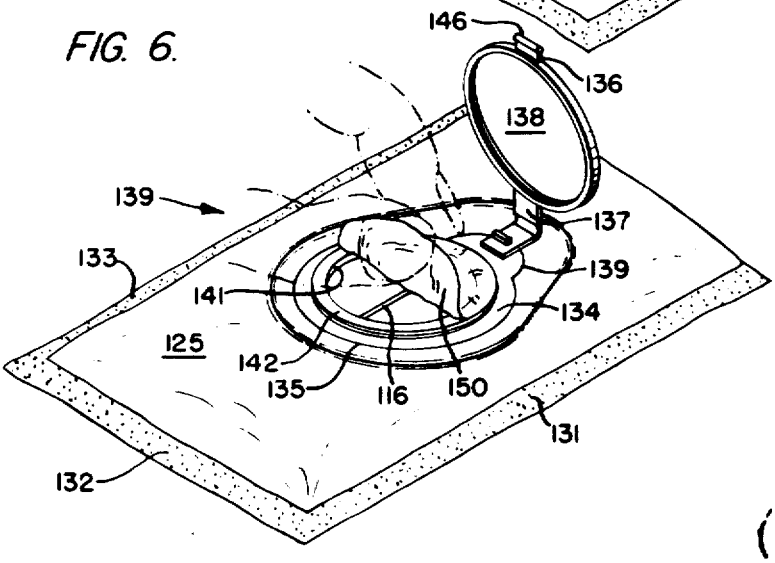
FIG. 6 shows a seventh embodiment of the present invention, wherein a flexible container similar to that shown in FIG. 2 has a prefolded sidewall and centrally mounted closure structure.

The embodiments shown in FIGS. 6 and 9 generally correspond to the embodiments shown in FIGS. 2, 3 and 4B, in terms of construction. However, in these Figures, the embodiments are directed to a container made of flexible material to facilitate the collapsing of the packet as articles are removed therefrom, a so called "limp-pack" packet.

Now looking at FIGS. 6, 7 and 8, the seventh embodiment will be described in detail. In FIG. 6, the packet 125 is formed about the towelettes by folding the flexible material along a median line defining a fold edge 130 and sealing the folded flexible material along exposed edges 131, 132 and 133. The packet 125 is sealed by a conventional method, such as heat sealing, ultrasonic sealing, or by using a strong adhesive to obtain a permanent seal. A resealable cap assembly indicated in general by reference numeral 139, and shown per se in FIG. 7, has a resealable cap 138 connected to a flexible "living" hinge 137. A pull tab 136 is formed on the cap 138 and the hinge 137 is detachably attached to a collar structure 134. The collar 134 of the cap assembly 139 is preferably attached to the inner surface of the flexible material of the packet by one of the methods suggested.

Figure 8:
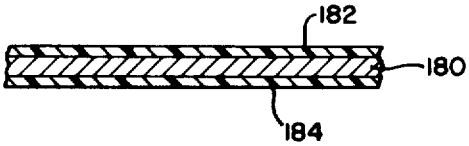
FIG. 8 is a fragmentary portion of the three-part laminated flexible material from which the flexible container may be made.

The flexible packet 125 is preferably formed of a flexible material having two or three laminations, as shown in FIG. 8. The laminated material of FIG. 8 includes a layer 182 of mylar secured to a layer 180 of aluminum foil and with another layer 184 of polyethylene. Normally, after the formation of the flexible container packet 125, the inner sealing film layer 184 of polyethylene will be on the inside of the packet and against the moist folded towelettes, while the center layer 180 of aluminum foil, and the outside layer 182 of mylar will provide the outer protective portions of the packet. Of course, a single layer of material, such as vinyl film, foil, or any other flexible single layer of material which can be permanetly sealed to provide a hermetically sealed container, as already described in the previous embodiments, may be used for the embodiment of FIG. 6. However, it has been discovered by the inventor that the use of the multiple layered flexible material offers increased security and moisture sealing capabilities over that of a single layer, while still retaining the desired flexibility and limpness required of such a packet to achieve the desired features of the invention.

A discontinuous area defining an opening 135 is formed in the flexible material, preferably before the packet 125 is formed. The opening 135 is of sufficient size to allow the appropriate portion of the resealable cap assembly 139 to protrude therethrough and to allow the remaining portion to be hermetically sealed to the flexible material. As shown in FIG. 7, the collar 134 is provided with protruding ridge portions 174 for the purpose of retaining sealing adhesive therebetween and in order to increase the soundness of the hermetic seal made with the inner side of the material of the flexible packet adjacent the opening 135.

Also, in order to add additional rigidity to the collar member 134, as well as providing an enlarged extra strength area for the hinge attaching projection 185, 186, the collar 134 is formed in approximately the shape of an egg. This can be easily visualized by viewing FIGS. 6 and 7.

The collar 134 is also provided with a central opening having an upstanding and projecting inner collar with flat sealing surface 142 provided thereon. This inner collar 141 has the sealing surface 142 so formed as to provide an external circumferential flange. This circumferential flange forms a recessed portion 143 on the outside of the collar.

The cover cap 138 has a depending flange 191 around the circumference thereof with the lower edge of this depending flange having an inwardly extending flange 193 to complement the recess 143 formed in the inner collar 141.

The hinge portion 137 also is normally provided with a central thinner or recessed protion 167 in order to increase the overall effectiveness of the hinge function. That is, with the central portion 167 of the hinge 137 being reduced, the natural result will be the bending of the hinge at this point with a "living" hinge effect.

For ease of manufacture, convenience of packaging and distribution, and ultimate ease of assembly and use by a final consumer of the overall product, it is preferable that the cover cap 138 and the hinge 137 be detachable from the collar portion 134. This is accomplished by means of the elongated aperture 169 in the attachment end of hinge 137 which complements and snaps over the projection 185, 186 formed integrally with the collar 134. The projection 185 extends outwardly of the collar 134 and has an enlarged head portion 186. This enlarged head portion 186 is just slightly larger than the elongated aperture 169 and thus will under suitable pressure pass and snap through the aperture when assembly of the closure cover cap to the packet is desired. This may be upon initial manufacture of the overall packet and prior to distribution to point of sale, and/or the ultimate end user of the product, or may be packed unattached together with the packet in a suitable outer package for assembly to the packet by the ultimate end user. The pull tab 136 has an enlarged rounded head portion 146 for ease of gripping by a user of the device for opening an reclosing the cover cap 138.

During the formation of opening 135 within the packet material, preferably a suitable extension cut-out 139 will also be provided to permit the hinge projection 185, 186 to be readily acessible. The embodiment of FIG. 6 is of rectangular configuration and of a compact size of approximately 4 inches in width by 6 inches in length. A packet of construction and size as just described forms a readily usable and convenient resealable and collapsible dispenser packet for moist towelettes. In order to prevent the possible drying out of the liquid with which the towelettes are moistened during a normal shelf-like period, a seal 150 of aluminum foil, or other similar material, preferably is provided over the outer sealing surface 142 of the inner collar 141. As shown in FIG. 6, when it is time for the ultimate user to put the moist towelettes into use, this hermetically sealed foil seal 150 may be easily detached and removed from the inner collar portion of the packet. Then a towelette may be removed, and after that the reclosable cover cap 138 put into place and snapped closed over the inner collar 142 as already described, to securely and hermetically reseal the packet.

Preferably the entire collar assembly, that is, both parts thereof, is made of flexible, resilient, plastic type material which may be easily deformed and compressed without any permanent change or damage thereto. Such plastic material will permit the necessary deformation of the hinge aperture 169 and the enlarged projecting head 186 when mounting the cover cap to the main collar structure. Also it will permit the necessary expansion of the depending circumferential flange 191 of the cover cap 138 when the cap is snapped onto the inner collar 141.

For some types of applications and uses, a source of larger towelettes and other liquid impregnated materials may be desirable. In such case, the embodiment shown in FIG. 9 may be employed. The reclosable cap structure 139' is generally the same as that already described. However, the flexible and collapsible packet 225 is of substantially square configuration, and approximately 6 inches by 6 inches. This modified embodiment may be formed of a single layer of material as described in the first embodiments of this invention, or may be of a multilayer laminated material as shown and described in connect on with FIGS. 6 and 8.

Figure 10:
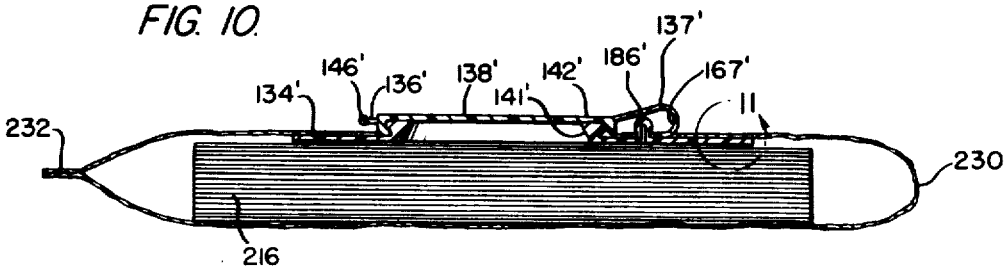
FIG. 10 is a cross section taken generally along lines 10—10 of FIG. 9.

The cross section of FIG. 10 shows the larger towelettes 216 in place, and also shows the mating and sealing of the inner side of the cover cap 138' against the sealing surface 142' of the inner collar 141. Also the enlarged rounded portion 146' of the pull tap 136' is clearly visible. Similarly, the enlarged head 186' on the projection 185' for the hinge attachment can be clearly seen to be larger than the width of the hinge aperture 169'. Furthermore, the bending action of the hinge 137' along the recessed portion 167' is clearly seen.

This packet 225 is formed about the towelettes 216 by folding the flexible material from which it is made along a median line defining a fold edge 230, and sealing the folded flexible material along the exposed edges 231, 232, and 233. The packet 225 is sealed by using a strong adhesive, heat sealing or ultrasonic sealing in order to provide a permanent hermetic seal.

Figure 7:
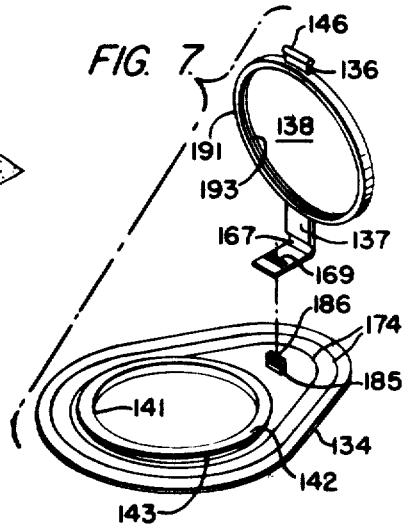
FIG. 7 is an exploded perspective view of the two-part reclosable cap structure per se.
Figure 11:
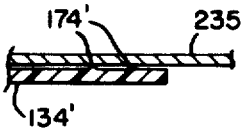
FIG. 11 is an enlarged fragmentary portion of FIG. 10 as indicated.

The enlarged portion of FIG. 10 shown in FIG. 11, clearly shows in cross section the sealing ribs 174' which correspond to those 174 in the perspective of FIG. 7. As stated proviously, these ridges 174, 174' assist in the hermetic sealing of the collar 134 to the inner side of the container in the case of the seal being made by using a strong adhesive; the space between the two ribs provides an area for the adhesive and prevents same from spreading very far past this designated area during the manufacturing process.

Looking at FIGS. 12 and 13, another embodiment of this invention will be described. This embodiment basically is a combination of the flexible, limp-pack pouch of FIG. 5A combined with the rigid, or semi-rigid plastic recloseable resealable structure of FIG. 7. Essentially, the seam 54 of the FIG. 5A embodiment is permanently sealed along the entire overlap thereof, in other words, instead of having an opening at 57, this area is entirely sealed. Prior to the sealing of the packet with the wipes or towelettes therewithin, a recloseable cap structure as in FIG. 7 has been hermetically sealed in the portion of the pouch opposite the area for the overlapping seam 54, 57.

Figure 12:
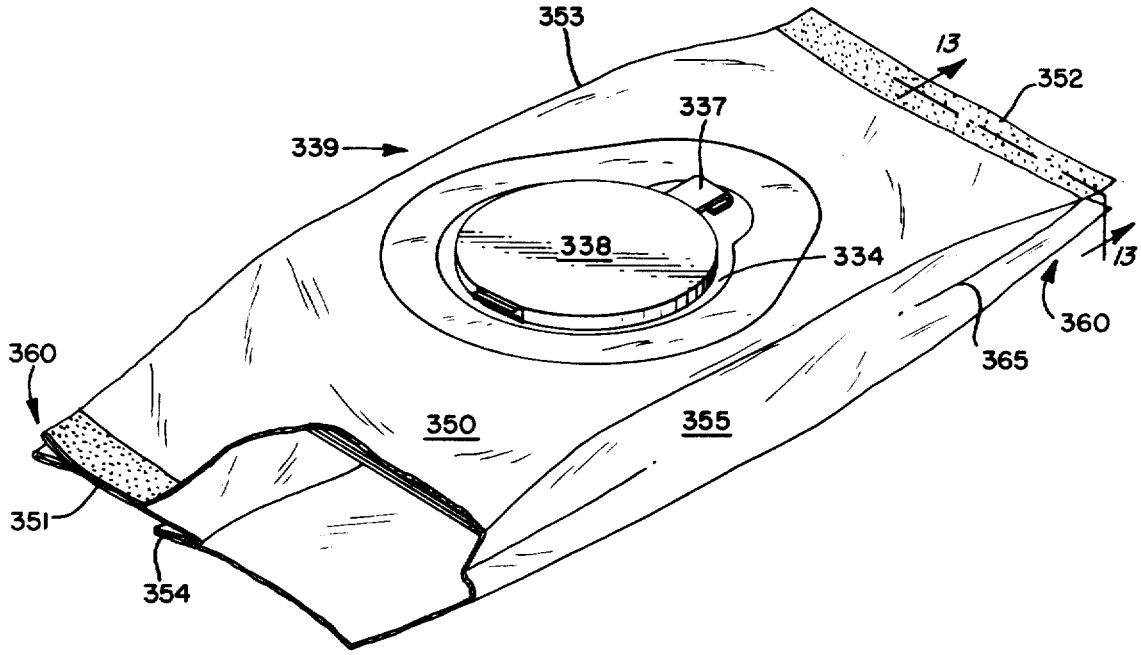
FIG. 12 is another embodiment wherein a hermatically sealed flexible container formed of a single sheet with overlapping edge and end seams has the two part resealable closure structure.

FIG. 12 shows the packet 350 formed of a single sheet of flexible material having two substantially parallel edges and being folded along fold areas 353 and 355 to enclose the wipe or towelette contents. An overlapping seam 354 is formed by the two parallel edges, which runs lengthwise of the packet 350. This entire seam 354 is permanently sealed where the edges meet, and preferably is folded flat against the overall packet. This can best be seen in FIG. 13 indicated by reference arrow 374. The end edges which also are overlapped at 351 and 352 are similarly permanently sealed in order that the contents will remain hermetically sealed therein.

A closeable and resealable cap structure 339 is also hermetically sealed to the pouch 350 as indicated. A collar portion 334 has removably attached thereto a hinge 337 for the cap 338 in the same manner as the structure already described with reference to FIG. 7.

Figure 13:
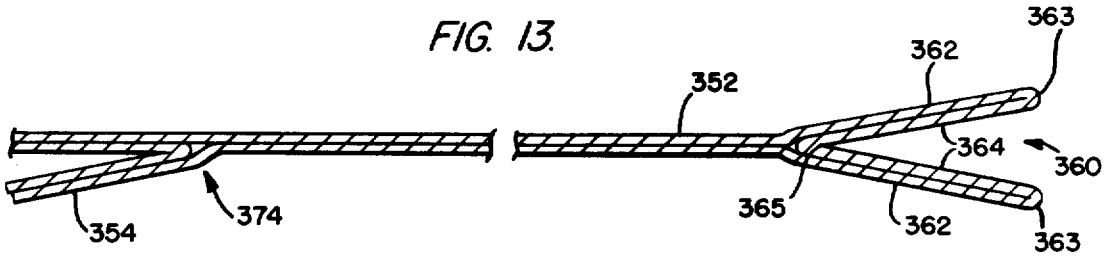
FIG. 13 is a cross section taken generally along lines 13—13 of FIG. 12.

In this embodiment of FIGS. 12 and 13, expandible and collapsible corner gussets 360 are provided at each of the four corners of the pouch. The packet corners 362 have portions 364 inwardly folded along lines 363 to form an inner fold 365. These gussets will permit the package to be filled during manufacture with as many wipes or towelettes as possible, and then permit the packet to be collapsed as the wipes or towelettes are removed through the reclosable cap structure for use.

Figure 14:
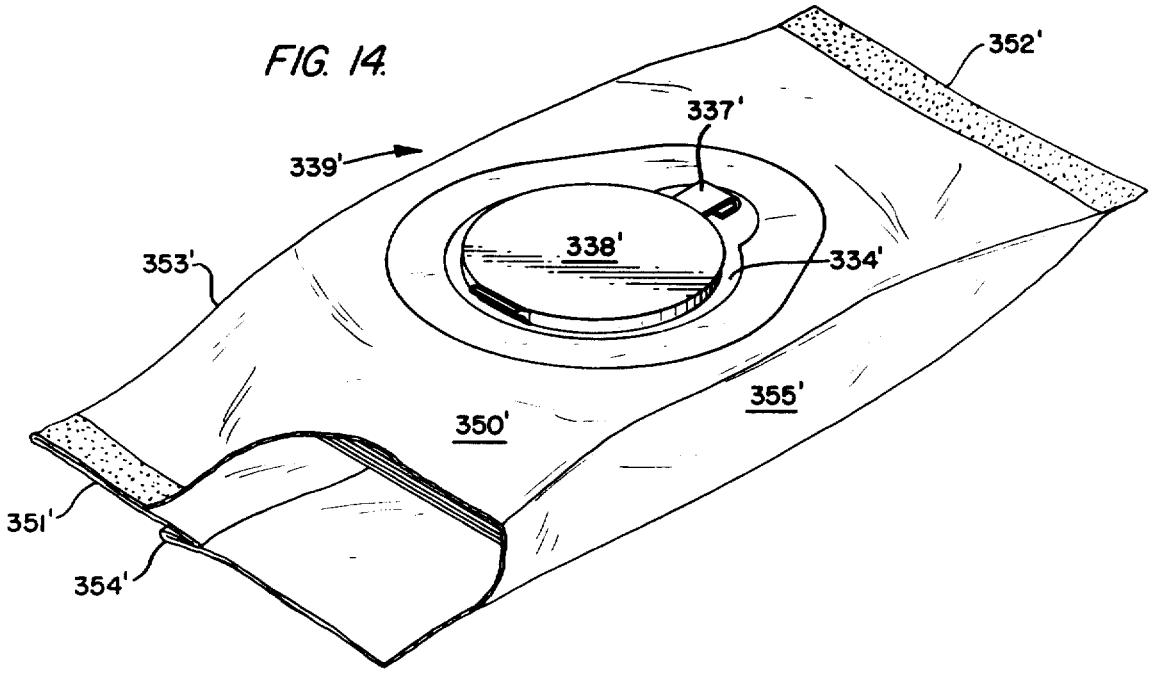
FIG. 14 is a modified embodiment of the FIG. 12 one.

The embodiment of FIG. 14 is similar to that described for FIGS. 12 and 13 but with the expansion gussets 360 omitted. That is, the overlapping end edges 351' and 352' are permanently sealed along the length thereof much in the manner of the FIG. 5A packet with the end edges 51 and 52. However, the reclosable cap structure 339' is similar to that already described for FIG. 7 and FIG. 12.

These latter embodiments provide a flexible pouch formed of a single sheet of flexible material folded so as to enclose the towelette contents. The mating and overlapping seams are permanently and hermetically sealed to keep the moistened towelettes from drying out. The resealable closure cap structure with collar and hinge may be formed of plastic material of the rigid, or semi-rigid type. This combination of flexible and collapsible pouch together with permanent reclosable cap structure is believed to be new and unique.

It will be apparent that many modifications and variations may be effected without departing from the scope of and the novel concept of this invention. Therefore, it is intended by the appended claims to cover all such modifications and variations which fall within the true spirit and scope of the invention.

What I claim is:

1. A disposable moisture impermeable "limp-pack" package for containing and dispensing moisture impregnated moisture impregnated towelettes comprising:

at least one thin sheet of "limp-pack" flexible material, having an opening defined therein, being hermetically sealed to define a container completely enclosing said towelettes, means for capping said opening in said flexible material and providing a moisture impermeable resealable closure for accessing and removing said towelettes contained in said package, wherein said capping means includes a resealable cap, a hinge portion and a circumferential collar, wherein said hinge portion attaches said cap to said circumferential collar and further wherein said collar is permanently mounted on said thin sheet of flexible material at said opening to provide a moisture impermeable seal therebetween.

2. A moisture impermeable package as in claim 1, wherein said hinge portion is detachable from the collar by a snap-coupling structure.

3. A moisture impermeable package as in claim 1, wherein said hinge portion is provided with a reduced central area for increasing the hinge effect along this area.

4. A moisture impermeable package as in claim 1, wherein said moisture impregnated towelettes are a prefolded stack of towelettes.

5. A moisture impermeable package as in claim 1, wherein said at least one thin sheet of flexible material is formed of a plurality of laminations.

6. A moisture impermeable package as in claim 1, wherein said at least one thin sheet of flexible material includes a sheet of aluminum foil.

7. A moisture impermeable package as in claim 6, wherein said plurality of laminations includes an inner layer of aluminum foil, and an outer layer on one side of said aluminum foil of mylar, and an outer layer on the other side of said aluminum foil of polyethylene.

8. A disposable moisture impermeable "limp-pack" package for containing and dispensing moisture impregnated towelettes through a resealable opening comprising:

at least one thin sheet of "limp-pack" flexible material, having an opening defined therein, being hermetically sealed to define a container completely enclosing said towelettes; and a resealable cap assembly comprising a cap portion, a hinge and a main collar portion having a configuration substantially corresponding to and being larger than said defined opening, said collar being permanently attached to said flexible material at said defined opening for hermetically sealing said defined opening.

9. A moisture impermeable package as in claim 8, wherein said at least one thin sheet of flexible material includes a sheet of aluminum foil.

10. A moisture impermeable package as in claim 8, wherein said at least one thin sheet of flexible material includes a plastic film.

11. A moisture impermeable package as in claim 8, further comprising means for increasing the hermetically sealing effect including a plurality of projecting ridges provided on said main collar portion, and when mounted together with the thin flexible material engaging therewith.

12. A moisture impermeable package as in claim 8, wherein the configuration of the main collar portion is generally egg-shaped.

13. A moisture impermeable package as in claim 8, wherein said at least one thin sheet of flexible material is formed of a plurality of laminations.

14. A moisture impermeable package as in claim 12, wherein the pointed end of said egg-shaped main collar portion is provided with means for detachably connecting said hinge of the cap portion thereto.

15. A moisture impermeable package as in claim 13, wherein one of said plurality of laminations consists of mylar material, another of said laminations consists of aluminum foil, and a further lamination consists of polyethylene.

16. A moisture impermeable package as in claim 15, together with moisture impregnated towelettes contained within said container, wherein said container of flexible laminated material is formed so that the polyethylene layer is inside of said container and next to the moisture impregnated towelettes for providing a relatively fail-safe hermetically sealed package.

17. A method of making a disposable moisture impermeable resealable package for moisture impregnated towelettes including the steps of:

providing at least one thin sheet of "limp-pack" flexible moisture impermeable material;

forming a discontinuous area in said at least one sheet to define an opening therein;

providing a resealable cap assembly comprising a cap portion, a hinge and a collar portion wherein said collar has a configuration which corresponds to and is larger than said defined opening;

permanently attaching said collar to said at least one thin sheet of material at said defined opening for hermetically sealing said defined opening;

and sealing edges of said at least one thin sheet of material to form a container from said material to completely enclose the towelettes contained in the package.

* * * * *